US005241980A

United States Patent [19]

Corte

[11] Patent Number: 5,241,980

[45] Date of Patent: Sep. 7, 1993

[54] OIL FIELD CHOKE APPARATUS

[75] Inventor: Bobby J. Corte, Houma, La.

[73] Assignee: Cor-Val, Inc., Houma, La.

[21] Appl. No.: 895,595

[22] Filed: Jun. 8, 1992

[51] Int. Cl.[5] ..... F16K 35/02; F16K 51/00

[52] U.S. Cl. ..... 137/315; 137/312; 166/91; 285/92; 285/924

[58] Field of Search ..... 137/312, 315, 377, 381, 137/382; 166/91; 70/DIG. 57; 285/80, 81, 90, 91, 92, 901, 924

[56] References Cited

U.S. PATENT DOCUMENTS

| | | | |
|---|---|---|---|
| 2,943,869 | 7/1960 | Nordin | 285/90 |
| 3,331,396 | 7/1967 | Willis | 137/625.31 |
| 3,426,797 | 2/1969 | Baker | 251/340 |
| 4,337,788 | 7/1982 | Seger | 137/315 |
| 4,921,281 | 5/1990 | Taylor | 285/90 |
| 4,926,898 | 5/1990 | Sampey | 137/315 |
| 5,065,787 | 11/1991 | Lochmann | 137/315 |

OTHER PUBLICATIONS

Willis Division of Smith International, Inc. brochure on 2" through 6" Multiple Orifice Valves.

*Primary Examiner*—George L. Walton

*Attorney, Agent, or Firm*—Pravel, Hewitt, Kimball & Krieger

[57] ABSTRACT

An improved choke valve apparatus for use in controlling oil well flow for example includes an improved interlock system for warning of a pressurized condition within the valve prior to removal of the valve wing nut member. The safety bleeder plug assembly includes a plug body threadably attached to an opening in the choke body. A pair of spaced apart spring loaded washers interfaces the bleeder plug body and the choke body to several hundred pounds per square inch of pressure so that inadvertent removal of the plug body and body is prevented.

6 Claims, 3 Drawing Sheets

OIL FIELD CHOKE APPARATUS

BACKGROUND OF THE INVENTION

1. Filed of The Invention

The present invention relates to an oil field choke valve apparatus with an improved safety locking arrangement that prevents removal of the main wing nut from the choke without first removal of a bleeder plug so that the operator will be warned if the system is still under pressure when the bleeder plug is backed off of its seat. Even more particularly, the present invention relates to a safety interlock system for an oil field choke valve apparatus which features an improved clamping arrangement that loads the connection of a bleeder plug body, an interlock clamp plate, the wing nut, and the choke valve body to deliver several hundred pounds of force, securing the bleeder plug body and clamp plate firmly into position on the choke valve body.

2. General Background

Oil field choke valves have been used commercially for a number of years. Many choke valves are the subject of issued patents. For example, the Baker U.S. Pat. No. 3,426,797 entitled "Multiple Orifice Valve" relates to a fluid control valve having an axially aligned inlet and outlet with relatively rotatable flow controlling disks in face engagement containing respectively a pair of similarly positioned diametrically opposed orifices, a cylindrical disk carrier fixedly mounting one of the disks having a central passage containing a separate sleeve liner connecting the disk orifices with the outlet. A rotatable cylindrical disk carrier mounts the other disk and has an actuator handle extending outward through the arcuate slot in the valve body. This carrier is sealed on opposite sides of the slot, the body being grooved between the seals and provided with a drain port. The rotatable carrier provides a central passage connecting its disk orifices with the inlet and being connected through a port passage with an annular chamber extending about the interface of the disks. The '797 patent was assigned to Willis Oil Tool Co. of Long Beach, CA. Willis, division of Smith International, Inc. sells a number of multiple orifice valves in various sizes. The Smith International, Inc. valves which are sold under the Willis name include for example Model M2 and Model M2G multi-orifice valve chokes.

U.S. Pat. No. 3,331,396 issued to R. S. Willis and entitled "Orifice Valve" discloses a multiple orifice valve usable in the control of flow of abrasive fluids such as the fluids produced from oil wells and the like. Such orifice valves of the '396 patent for example are used in the control of for example well production fluids, to control the rate of flow through a flow line within a range predetermined by the number and size of a plurality of orifices in a relatively stationary orifice disk or member and a rotatable disk or member. The orifices are adapted to be brought more or less into alignment upon angular movement of the rotatable orifice disk.

There are commercially available chokes which allow pressure relief through a bleeder assembly prior to the opening of the valve by removal of a wing nut. However, these valves suffer because many times the valve design does not provide a strong interface between a bleeder assembly and the valve body. This prevents a potential problem of leakage, and possibly valve failure if the bleeder plug assembly (plug body and plug) become loosened in connection with the entire apparatus of the choke.

U.S. Pat. Nos. 3,426,797 and 3,331,396 are hereby incorporated herein by reference.

SUMMARY OF THE PRESENT INVENTION

The present invention provides a safety interlock system of improved construction for use with choke valves, wherein spring loaded members create a very structurally rigid, preloaded assembly of the bleeder plug, bleeder plug housing, interlock clamp, and choke valve body when the bleeder plug is assembled to the choke body. The spring loaded members are compressed upon a threaded engagement of the bleeder plug body into an internally threaded opening on the choke valve body.

The apparatus of the present invention thus provides an improved oil well choke valve apparatus that has a valve body with an internal flow bore, a wing nut that threadably attaches to the valve body and which can be removed to expose the bore, an orifice within the valve bore for restricting flow through the choke valve, and the orifice being removable with respect to the valve body after removal of the wing nut from the valve body.

A plate interlocks the wing nut and the valve body when the plate is properly aligned using an indexing pin, so that the wing nut cannot be removed until the plate is removed. The plate is held in position by a bleeder plug body which threadably attaches to the valve body. A bleeder plug is movably mounted within the plug body between open flow and closed flow positions.

In the open flow position, the bleeder plug allows pressurized fluid to flow from inside the valve bore to atmosphere so that a pressurized condition can be determined upon movement of the bleeder plug from its seat to an open flow position.

Interfacing spring members tightly secure the bleeder plug body into an internally threaded opening on the choke body and with the interlock plate, for loading the connection between the bleeder plug body, the interface plate, the wing nut, and the choke body to prevent inadvertent disassembly during use.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
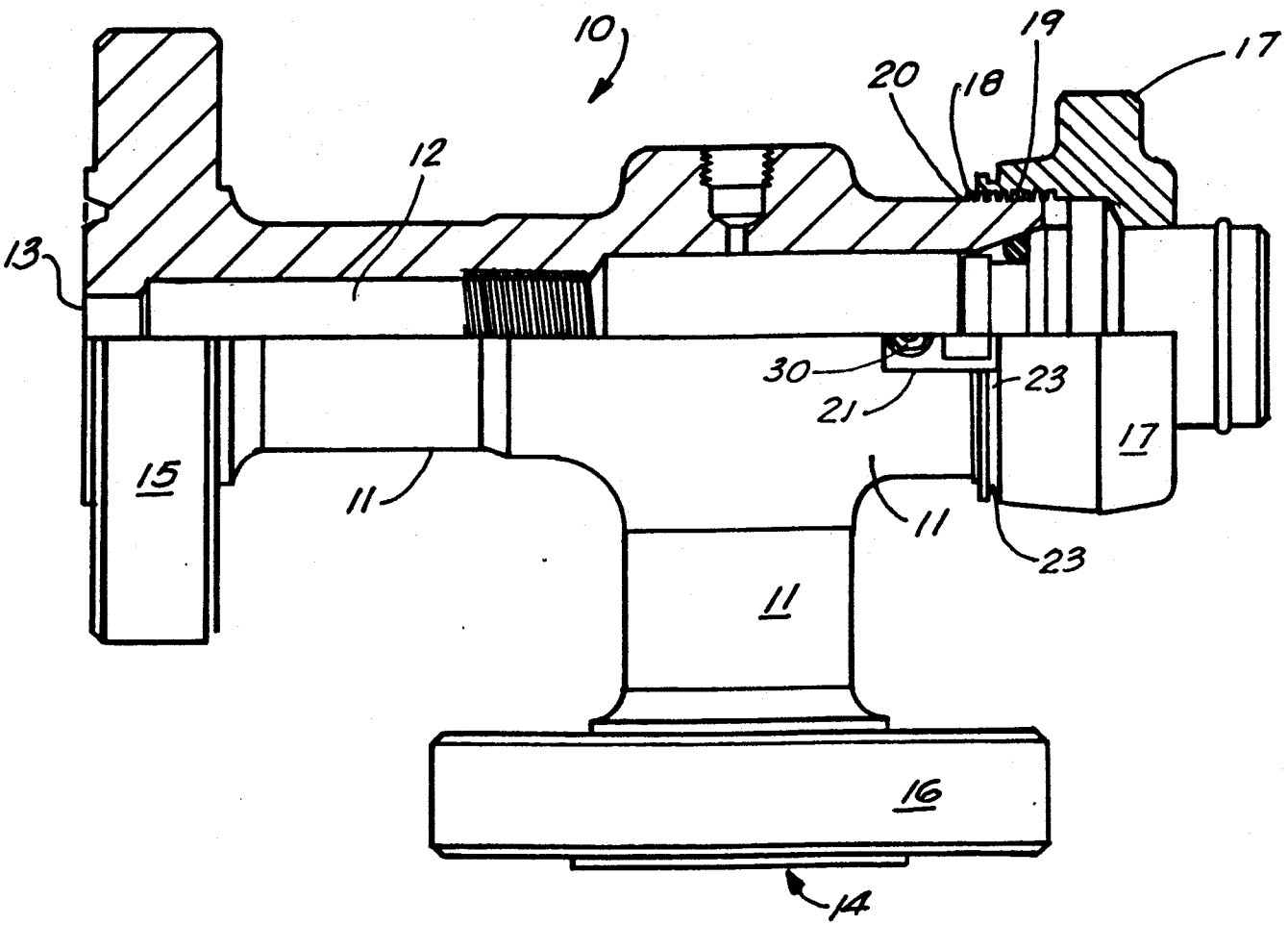
FIG. 1 is a sectional view of the preferred embodiment of the apparatus of the present invention.

FIG. 1 illustrates generally a choke valve 10 apparatus of the present invention showing a valve body 11 having an internal bore 12 that communicates with a pair of openings 13, 14, each being adapted for connection to piping assemblies. Each opening, 13, 14 can be part of a flanged connection 15, 16 so that the choke valve apparatus 10 can be bolted for example to adjoining piping systems, pipe spools, or oil well christmas tree or the like. Choke valves in general are commercially available, sold by Willis Oil Tools Division of Smith International, Inc. for example. Choke valves are shown for example in U.S. Pat. Nos. 3,426,797 and 3,331,396, each of which is incorporated herein by reference.

Choke valve apparatus 10 includes a wing nut portion 17 that threadably attaches to valve body 11 at threaded connection 18. Thus, the wing nut 17 provides internal threads 19 that engage external threads 20 of valve body 11.

Figure 2:
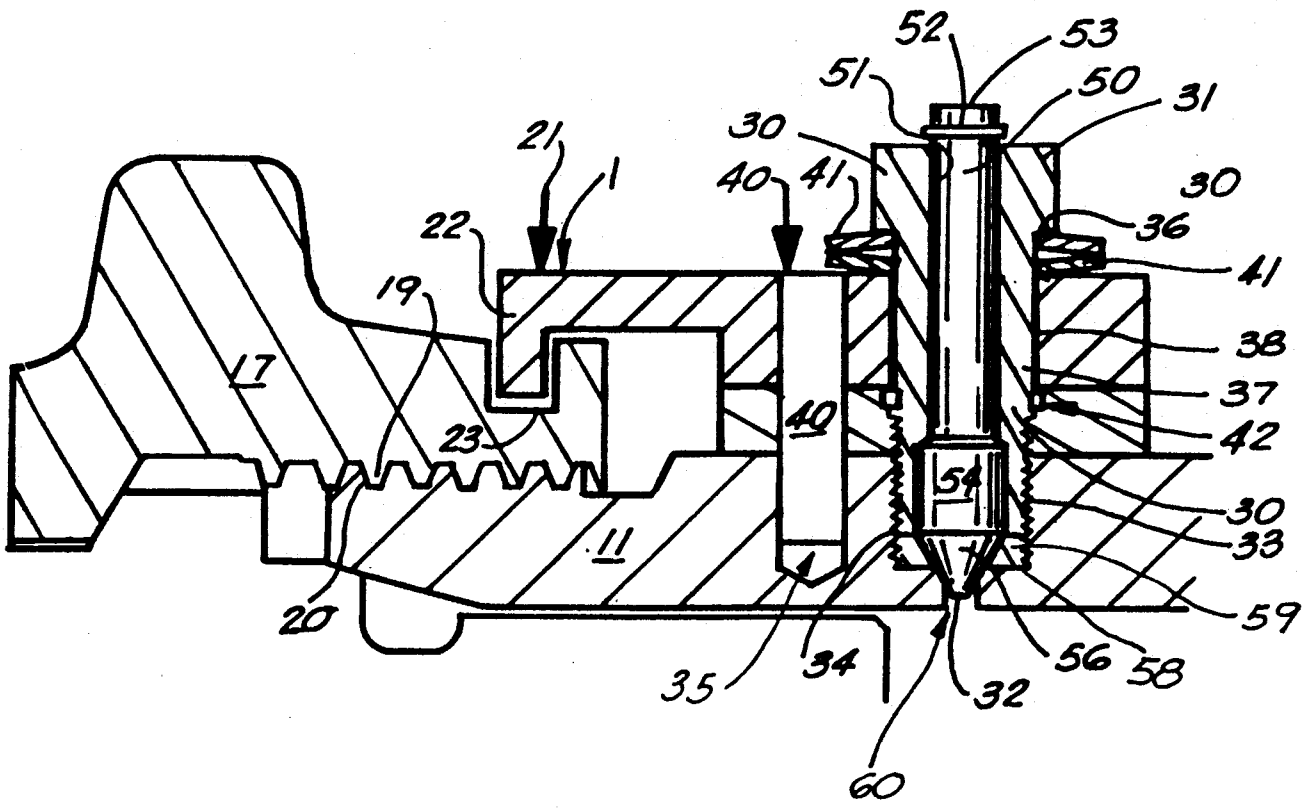
FIG. 2 is a fragmentary sectional view of the preferred embodiment of the apparatus of the present invention.

In FIG. 2, a fragmentary view of valve body 11 and wing nut 17 are shown which illustrates more particularly the threaded connection between internal threads 19 and external threads 20 of valve body 11 upon assembly. In FIG. 2, interlock clamp plate 21 forms a connection between wing nut 17 and valve body 11 which prevents an inadvertent removal of wing nut 17 from valve body 11 until the valve has all pressure within bore 12 relieved. Clamp 21 has a portion 22 which registers into an annular slot 23 of wing nut 17.

Interlock clamp plate 21 carries bleeder plug body 30 which includes an upper end portion 31 and a lower end portion 32. Lower end portion 32 includes a helically externally threaded portion 33 which engages a similar internally threaded port 34 of body 11.

To assemble the plate 21 and plug body 30, an alignment pin 40 registers interlock clamp 21 in its proper position both with reference to wing nut 17 and threaded opening 34 of valve body 11. Bleeder plug body 30 carries an annular shoulder 36 adjacent the upper hex head end 31, as having a maximum diameter of bleeder pluq body 30. A pair of spring loaded members 41 are positioned during use between shoulder 35 of bleeder plug body 30 and the upper surface 24 of interlock clamp plate 21. Snap ring 42 fits an annular groove in plug body 31. The lower surface of plate 21 is abutted by snap ring 31.

Figure 3:
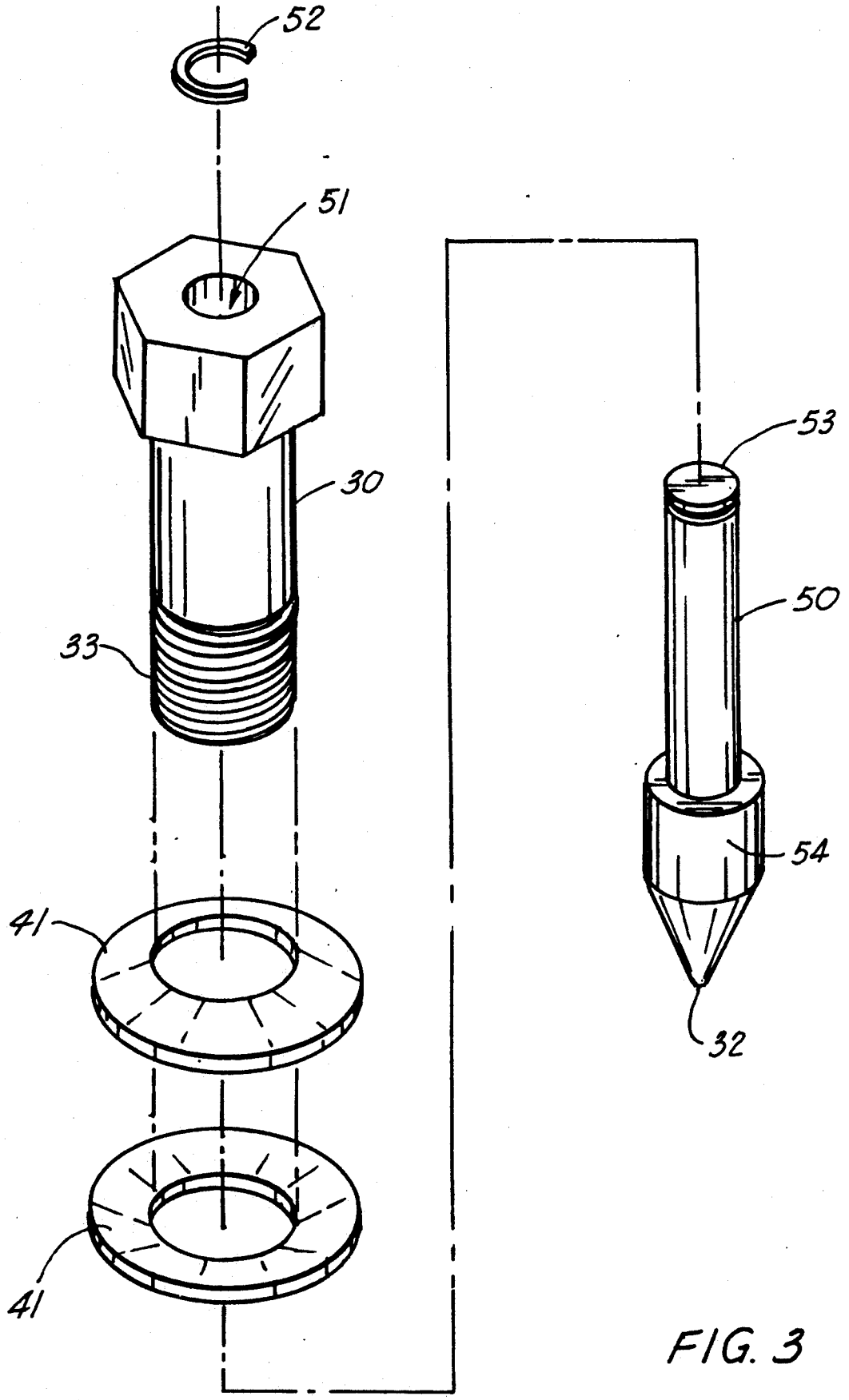
FIG. 3 is an exploded, perspective fragmentary view illustrating the plug body, plug member, and spring loaded members.

Bleeder plug body 30 provides a transitional cylindrically shaped midportion 37 that fits a similarly shaped opening 38 in interlock clamp plate 21. Snap ring 42 and spring loaded members 41 secure bleeder plug body 30 in opening 38. After aligning pin 40 is placed into correspondingly shaped pin socket 35 of valve body 11, and tab portion 22 fits annular groove 23 of wing nut 17, plug body 31 external threads 33 can engage internal threads 44. When the lower end 32 of plug 50 bottoms out by hitting the transverse face 59 of plug body socket 58 at venting opening port 60, continued rotation of plug body 30 begins to compress spring loaded members 41. A torque wrench setting for example of forty five (45) foot pounds has been found to very securely load the assembly of plug body 30, plate 31, and valve body 11. This prevents vibration of plate 21 and plug body 30 which can cause loosening of the threaded connection between plug body 30 and valve body 11, considering that such valves 10 are usually left in service unattended for months at a time. Such loosening could be catastrophic, because choke valves 10 handle extremely high pressures and convey extremely dangerous fluids such as natural gas. Spring loaded members 41 load the hex head upper portion 31 of bleeder plug body 30 and the top surface 24 of interlock clamp 21 as body 30 is tightened. Spring loaded members 41 can be for example a pair of opposed bellview washers as shown in FIGS. 2-3.

The use of the two spaced apart spring loaded members 41 preload the entire assembly of bleeder plug body 30, interlock clamp 21, and valve body 11 so that inadvertent loosening or removal of bleeder plug body 30 from valve 11 is discouraged.

A bleeder plug 50 slidably fits within a longitudinally extending bore 51 of plug 30. Snap ring 52 fits the top portion 53 of bleeder plug 50. The bottom portion 53 of bleeder plug 50 is enlarged providing an enlarged cylindrical portion 54 and an enlarged fructroconical section 55. The remainder of plug 50 is smaller, generally conically shaped portion 56. The bottom of plug body 30 is shaped to receive plug 50. Vent opening port 60 defines a pressure relief outlet so that when the snap ring is lifted, gas can escape into socket 58 between bleeder plug 50 and bore 51 to indicate whether or not the bore 12 of choke valve apparatus 10 is pressurized. If the bore 12 is overpressurized, an operator can relieve pressure within the bore 12 of choke valve apparatus 10 by alternate piping.

The following table lists the part numbers and part descriptions as used herein and in the drawings attached hereto.

TABLE 1

PARTS LIST

| PART NO. | DESCRIPTION |
|---|---|
| 10 | choke valve apparatus |
| 11 | body |
| 12 | bore |
| 13 | outlet |
| 14 | outlet |
| 15 | flanged connection |
| 16 | flanged connection |
| 17 | wing nut |
| 18 | threaded connection |
| 19 | internal threads |
| 20 | external thread |
| 21 | interlock clamp plate |
| 22 | tab portion |
| 23 | annular groove |
| 24 | upper surface |
| 30 | body |
| 31 | upper end plug body |
| 32 | lower end plug body |
| 33 | threaded portion |
| 34 | internal threaded portion |
| 35 | pin socket |
| 36 | annular shoulder |
| 37 | transitional portion |
| 38 | opening |
| 40 | alignment pin |
| 41 | spring loading member |
| 42 | snap ring |
| 50 | bleeder plug |
| 51 | longitudinal bore |
| 52 | snap ring |
| 53 | top of plug |
| 54 | cylindrical section |
| 56 | conical section |
| 57 | lower end |
| 58 | plug body socket |
| 59 | transverse face |
| 60 | venting port |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An oil well choke valve apparatus comprising:

(a) a valve body having an internal flow bore;

(b) a wing nut threadably attachable to the valve body, the wing nut having a recess opening thereon;

(c) orifice means disposed within the valve body for restricting flow through the flow bore, the orifice means being removably with respect to the valve body upon removal of the wing nut from the valve body;

(d) interlocking plate means removably attachable to the valve body and wing nut in an operative locking position, for interlocking the wing nut and the valve body at the recess opening of the wing nut, the plate means including a locking member that occupies the recess opening in the locking position so that the wing nut cannot be removed until the interlocking plate means is removed;

(e) bleeder plug body means connecting the interlock plate means to the valve body and including connecting means for connecting the bleeder plug body means to the choke body;

(f) relief port means extending between the valve body and the valve exterior surface and at least partially positioned in the plug body means, for venting the flow bore to atmosphere;

(g) a bleeder plug assembly movably mounted within the plug body between open flow and closed flow positions, and wherein in the open flow position, the bleeder plug allows pressurized fluid to flow through the relief port means and to the atmosphere so that a pressurized condition can be determined upon movement of the bleeder plug to an open flow position; and (h) spring means positioned between the bleeder plug body and the plate means for holding the locking member of the plate means in the recess opening for loading the connection between the bleeder plug body and the choke body.

2. The oil well choke valve apparatus of claim 1 wherein the bleeder plug means threadably engages the valve body for connecting the bleeder means to the choke body.

3. The oil well choke valve apparatus of claim 1 wherein the bleeder plug means comprises a generally cylindrically shaped member having an enlarged upper end portion, a smaller diameter center portion and a frustroconically shaped lower portion.

4. The apparatus of claim 3 wherein the upper enlarged end portion of the bleeder plug means provides an annular shoulder.

5. The apparatus of claim 1 wherein the spring means comprises a spring loaded member that fits between the upper end portion of the bleeder plug means and the plate means.

6. An oil well choke valve apparatus comprising:

(a) a valve body having an internal flow bore;

(b) a wing nut threadably attachable to the valve body, the wing nut having a recess opening thereon;

(c) orifice means disposed within the valve body for restricting flow through the flow bore, the orifice means being removably with respect to the valve body upon removal of the wing nut from the valve body;

(d) interlocking plate means removably attachable to the valve body and wing nut in an operative locking position, for interlocking the wing nut and the valve body as the recess opening of the wing nut;

(e) the plate means including cooperating interlocking portion that is received within the recess opening in the locking position so that the wing nut cannot be removed until the interlocking plate means is removed from the locking position;

(f) bleeder plug body means connecting the interlock plate means to the valve body and including connecting means for connecting the bleeder plug body means to the choke body;

(g) relief port means extending between the valve body and the valve exterior surface and at least partially positioned in the plug body means, for venting the flow bore to atmosphere;

(h) a bleeder plug assembly movably mounted within the plug body between open flow and closed flow positions, and wherein in the open flow position, the bleeder plug allows pressurized fluid to flow through the relief port means and to the atmosphere so that a pressurized condition can be determined upon movement of the bleeder plug to an open flow position; and (i) spring means positioned between the bleeder plug body and the plate means for holding the cooperating interlocking portion within the recess opening in the locking position for loading the connection between the bleeder plug body and choke body.

* * * * *